US008893688B2

(12) United States Patent
Ruppel et al.

(10) Patent No.: US 8,893,688 B2
(45) Date of Patent: Nov. 25, 2014

(54) DEVICE FOR VENTING A CRANK SPACE

(75) Inventors: Stefan Ruppel, Heidelberg Emmertsgrund (DE); Yakup Özkaya, Kornwestheim (DE); Leszek Goerlich, Leonberg (DE)

(73) Assignee: Mahle International GmbH (DE)

( * ) Notice: Subject to any disclaimer, the term of this patent is extended or adjusted under 35 U.S.C. 154(b) by 1638 days.

(21) Appl. No.: 12/439,416

(22) PCT Filed: Aug. 31, 2007

(86) PCT No.: PCT/EP2007/059091

§ 371 (c)(1), (2), (4) Date: Sep. 16, 2009

(87) PCT Pub. No.: WO2008/028863

PCT Pub. Date: Mar. 13, 2008

(65) Prior Publication Data

US 2010/0006075 A1 Jan. 14, 2010

(30) Foreign Application Priority Data

Sep. 2, 2006 (DE) ..... 10 2006 041 213

(51) Int. Cl.

| | |
|---|---|
| ***F02B 25/06*** | (2006.01) |
| ***F01M 13/02*** | (2006.01) |
| *F01M 13/04* | (2006.01) |
| *F01M 13/00* | (2006.01) |

(52) U.S. Cl.

CPC ..... *F01M 13/023* (2013.01); *F01M 2013/0494* (2013.01); *F01M 2013/0433* (2013.01); *F01M 13/0011* (2013.01); *F01M 13/04* (2013.01)

USPC ..... 123/573; 123/572; 123/574; 123/41.86; 123/196 A

(58) Field of Classification Search

USPC ..... 123/572–574, 41.86, 196 A

See application file for complete search history.

(56) References Cited

U.S. PATENT DOCUMENTS 2,230,278 A * 2/1941 Walton ..... 55/487
2,775,960 A * 1/1957 Druzynski ..... 123/574

(Continued)

FOREIGN PATENT DOCUMENTS

AT 275007 10/1969
DE 20009605 10/2001

(Continued)

OTHER PUBLICATIONS

English translation for JP 2002-106320.

(Continued)

*Primary Examiner* — Lindsay Low
*Assistant Examiner* — Tea Holbrook
(74) *Attorney, Agent, or Firm* — Rader, Fishman & Grauer PLLC

(57) ABSTRACT

The present invention relates to a device for venting a crank space in an internal combustion engine (1) having a suction device (5) for sucking out blow-by gases from the crank space (3) and having a venting line (4) which leads from the crank space (3) to the suction device (5) and in the course of which a throttle device (6) or a pressure regulating element (7) is arranged in order to bound a partial pressure which is generated by the suction device (5) in the crank space (3). It is essential to the invention here that an oil mist separator (8) which is embodied as an impactor is integrated into the throttle device (6) or into the pressure regulating element (7).

11 Claims, 3 Drawing Sheets

(56) References Cited

U.S. PATENT DOCUMENTS

Figure 1:
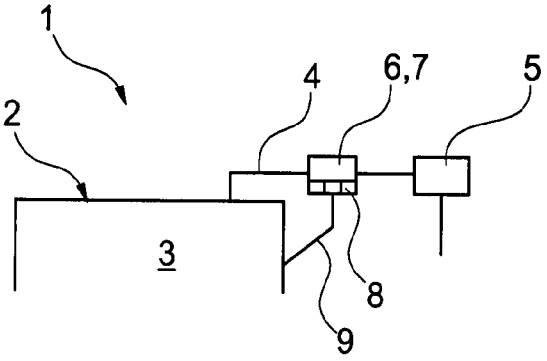

| | | | | | |
|---|---|---|---|---|---|
| 3,144,011 | A | * | 8/1964 | Anthes | 123/574 |
| 3,455,285 | A | * | 7/1969 | Sheppard | 123/574 |
| 3,807,144 | A | * | 4/1974 | Graybill | 96/292 |
| 4,390,036 | A | * | 6/1983 | Athanassiu et al. | 137/116.5 |
| 4,502,452 | A | * | 3/1985 | Whitehead | 123/574 |
| 4,580,543 | A | | 4/1986 | Aoki | |
| 4,861,359 | A | * | 8/1989 | Tettman | 55/419 |
| 5,090,393 | A | * | 2/1992 | Holch | 123/574 |
| 6,261,333 | B1 | * | 7/2001 | Dickson | 55/385.3 |
| 6,290,738 | B1 | * | 9/2001 | Holm | 55/309 |
| 6,422,224 | B1 | * | 7/2002 | Walker, Jr. | 123/572 |
| 6,475,255 | B1 | * | 11/2002 | Walker, Jr. | 55/315 |
| 6,635,095 | B2 | * | 10/2003 | Tanaka | 55/337 |
| 6,723,149 | B2 | * | 4/2004 | Ernst et al. | 55/498 |
| 6,802,303 | B2 | * | 10/2004 | Håkansson | 123/574 |
| 6,858,051 | B2 | * | 2/2005 | Uhlenbrock | 55/321 |
| 6,889,674 | B2 | * | 5/2005 | Pateman et al. | 123/574 |
| 7,124,752 | B2 | * | 10/2006 | Bedkowski | 123/572 |
| 7,473,291 | B2 | * | 1/2009 | Evenstad et al. | 55/416 |
| 2002/0134102 | A1 | * | 9/2002 | Morimoto et al. | 62/470 |
| 2003/0075046 | A1 | | 4/2003 | Lenzing | |
| 2006/0059875 | A1 | | 3/2006 | Malgorn et al. | |
| 2006/0062699 | A1 | * | 3/2006 | Evenstad et al. | 422/110 |
| 2009/0114088 | A1 | | 5/2009 | Evenstad et al. | |
| 2009/0250044 | A1 | * | 10/2009 | Braun et al. | 123/573 |

FOREIGN PATENT DOCUMENTS

| | | | | | |
|---|---|---|---|---|---|
| DE | 10051307 | | | 5/2002 | |
| DE | 10320215 | | | 12/2004 | |
| DE | 10321211 | | * | 12/2004 | F01M 13/02 |
| DE | 102005043198 | | | 3/2006 | |
| DE | 102004049089 | | | 4/2006 | |
| GB | 1092567 | | | 11/1967 | |
| GB | 1109693 | | | 4/1968 | |
| JP | 60-184914 | A | | 9/1985 | |
| JP | 63-90013 | U | | 6/1988 | |
| JP | 11200832 | | | 7/1999 | |
| JP | 2002-106320 | A | | 4/2002 | |
| JP | 2006316698 | | * | 11/2006 | F01M 13/04 |
| WO | WO-2007/000281 | | | 1/2007 | |
| WO | WO 2007137916 | A2 | * | 12/2007 | |

OTHER PUBLICATIONS

English abstract of JP-11200832.
English abstract provided for DE-102004049089.
International Search Report for PCT/EP2007/059091.
English abstract for DE-10320215.

* cited by examiner

DEVICE FOR VENTING A CRANK SPACE

CROSS-REFERENCES TO RELATED APPLICATION

This application is a National Stage application which claims the benefit of International Application No. PCT/EP2007/059091 filed Aug. 31, 2007, which claims priority based on German Patent Application No. DE 102006041213.3, filed Sep. 2, 2006, both of which are hereby incorporated by reference in their entirety.

The invention relates to a device for venting the crank space in an internal combustion engine according to the preamble of claim 1.

Such devices of the generic type are known from the practice of engine design, especially in automotive engineering. The essential object of such a device is to maintain the vacuum in the crankcase of the internal combustion engine, as required for technical and statutory reasons, by venting the crankcase and/or crank space. Oil components dissolved and/or entrained in the venting gas exhausted out of the crank space are then separated in an oil mist separator, preferably recycling the oil thereby separated back to the lubricating oil circulation of the crank space. The gas, freed of oil, goes into the intake manifold of the internal combustion engine, then again passes goes the combustion taking place in the cylinder.

The invention relates to the problem of providing an improved embodiment or at least a different embodiment of the generic type of a device for venting the crank space, in which effective separation of oil mist can be achieved without any great technical complexity.

This problem is solved by a device having all the features of patent claim 1. Advantageous and expedient embodiments are the subject matter of the dependent subclaims.

The invention is based on the general idea that, in a device for venting a crank space of an internal combustion engine, an oil mist separator embodied as an impactor may be integrated into a throttle device, which is present anyway in a venting line or a pressure-regulating element. The venting line leads from the crank space to the suction device, which serves to remove blow-by gases from the crank space and has either a throttle device or a pressure-regulating element in the course thereof to limit the vacuum created in the crankcase by the suction device. Such a throttle device or such a pressure-regulating element usually achieves regulation and/or throttling of the pressure through a valve which, thereby causing a great acceleration of the blow-by gases, so an arrangement of an oil mist separator embodied as an impactor in the immediate vicinity downstream from such a valve is especially effective and also does not require an increased structural complexity. In particular, additional acceleration of the vented blow-by gases is unnecessary because they already have a high velocity in the area of the pressure-regulating element and/or in the area of the throttle device. The invention thus utilizes the finding that the pressure-regulating element that is present anyway and/or the throttle device that is present anyway may be used to accelerate the blow-by gases, which are then purified to remove the oil mist components in the oil mist separator arranged directly downstream.

The oil mist separator expediently has an oil-collecting space which is connected by a valve to an oil return line through which separated oil can be sent back to the crank space. This valve is preferably a so-called discontinuously operating valve that is closed during operation of the internal combustion engine, for example, and opens only when the combustion engine is turned off. This can be achieved, for example, by a valve which closes when there is a vacuum and opens when there is no vacuum. The oil that is present in the blow-by and is separated by the oil mist separator is collected in the oil-collecting space of the oil mist separator and is then sent back to the crank space through the oil return line and is thus sent for lubrication. This forms a closed circuit for the oil that is required for lubrication, thus virtually ruling out emissions of oil into the environment.

In an advantageous further embodiment of the inventive approach, the pressure-regulating element has a spring-loaded throttle valve or an elastic, rotationally symmetrical diaphragm. Both devices regulate a mass flow through the pressure-regulating element as a function of the applied vacuum, such that the throttle valve as well as the rotationally symmetrical diaphragm allow a greater mass flow to pass through the pressure-regulating element when the vacuum is low than when the vacuum is greater.

The elastic diaphragm here expediently has a conical mandrel which, when the pressure-regulating element is at least partially closed, passes through a through-opening in the pressure-regulating element, so that together with an opening edge of the through-opening, it forms a nozzle, such that the conical mandrel is at least partially covered with a nonwoven for separation of oil mist. Depending on the applied vacuum, the conical mandrel extends to different distances into or through the through-opening, so that a annular gap formed between the mandrel and the opening edge of the through-opening has a different size. With a high applied vacuum, the mandrel extends far into the through-opening, so that the annular gap remaining between the mandrel and the opening edge of the through-opening is small and forms a small flow cross section accordingly. One surface of the mandrel is essentially opposite the nozzle formed by the mandrel and the opening edge, so the mandrel may be used as a baffle, which is covered with the aforementioned nonwoven for improved separation of oil mist. In this way, the pressure-regulating element which is present anyway is used at the same time as an oil mist separator, so that the functionality of the pressure-regulating element can be increased significantly. This eliminates the need for another separate oil mist separator, so that, at first, the cost of materials and logistics may be eliminated and secondly an especially compact design can be achieved.

Figure 2:
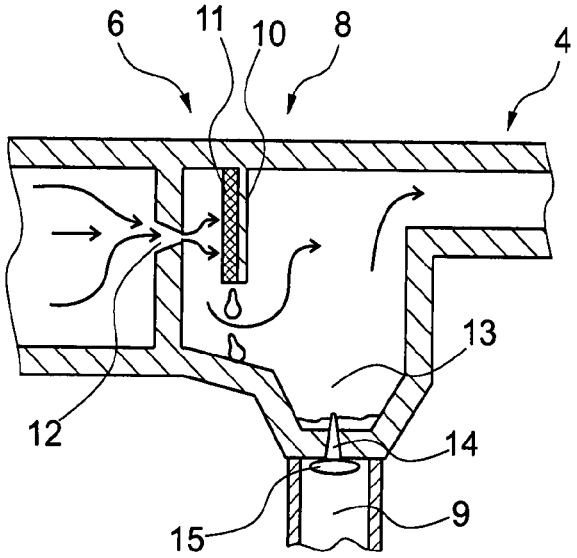
Figure 3:
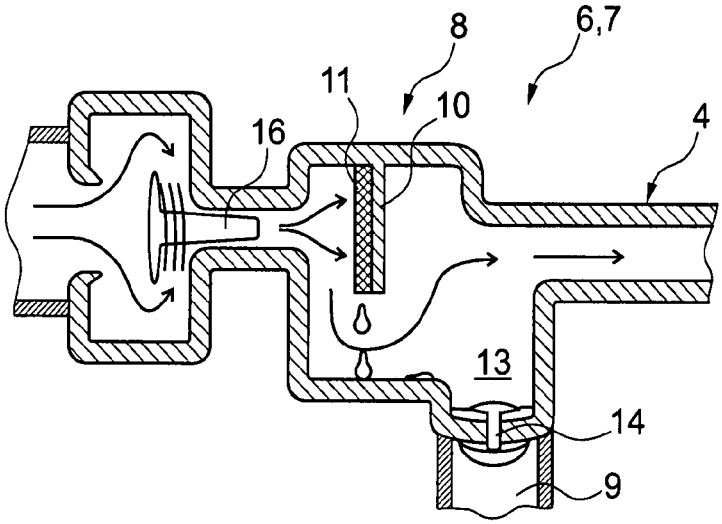
Figure 4:
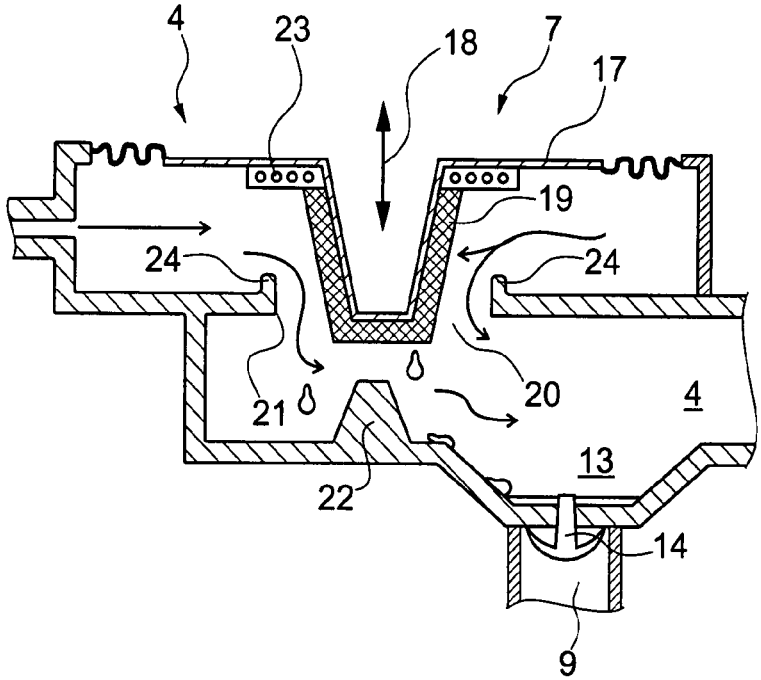
Figure 5:
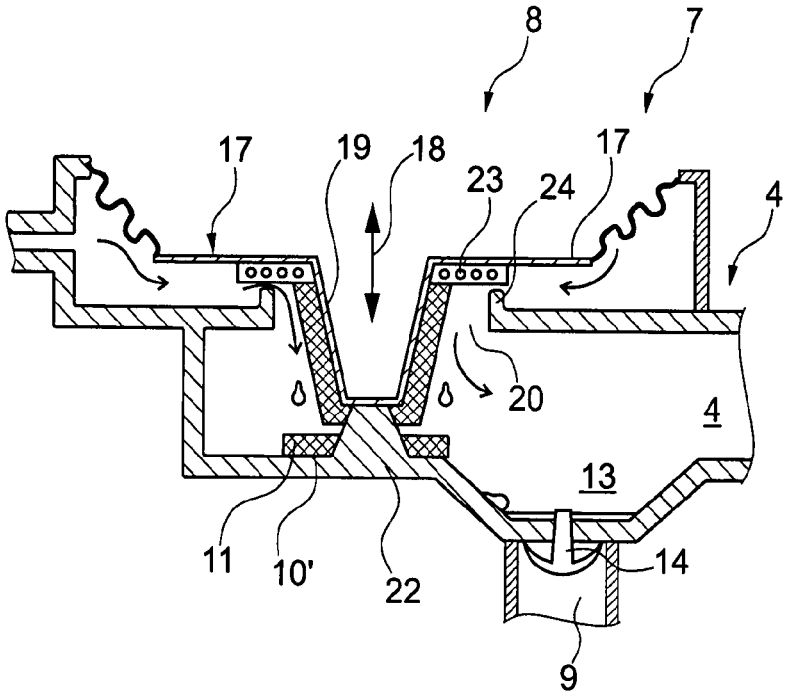

Advantageous exemplary embodiments that are explained in greater detail below are diagrammed schematically in the drawings, in which:

FIG. 1 shows a crank space of an internal combustion engine with an inventive device for venting the crank space, FIG. 2 shows an inventive throttle device having an integrated oil mist separator, FIG. 3 shows a diagram like that in FIG. 2, but with a different embodiment, FIG. 4 shows a pressure-regulating element with an integrated oil mist separator, FIG. 5 shows a diagram like that in FIG. 4, but with the pressure-regulating element almost completely closed.

According to FIG. 1, an internal combustion engine 1, which is shown only partially, has a crankcase 2 with a crank space 3, which is connected to a suction device 5 via a venting line 4. The suction device 5 is formed from the crank space 3 for suction removal of blow-by gases from the crank case 3, such that a throttle device 6 or a pressure-regulating element 7 is arranged in the path of the venting line 4 between the crank space 3 and the suction device 5 in order to limit the vacuum created by the suction device 5 in the crank space 3. According to the invention, an oil mist separator 8 embodied as an impactor is integrated into the throttle device 6 or into the pressure-regulating element 7. The oil mist separator 8 is connected by an oil return line 9 to the crank space 3, so that oil separated from the blow-by gases through the oil mist separator 8 can be collected and returned back to the crank space 3. In this way, emissions of oil dissolved in the blow-by gases to the outside can at least be reduced and furthermore an almost closed oil circuit can be created.

According to FIG. 2, an oil mist separator 8, which is integrated into the throttle device 6, is embodied as an impactor. The oil mist separator 8 has a baffle 10, which is preferably covered with a nonwoven 11 for oil mist separation. The nonwoven 11 is arranged on one side of the baffle 10 opposite a nozzle 12 so that the blow-by gases strike directly on the baffle 10 and/or the nonwoven 11 after being accelerated in the nozzle 12. The nonwoven 11 collects the oil mist that is separated and then drops downward when the nonwoven 11 becomes saturated and flows into an oil-collecting space 13 of the oil mist separator 8. The separated oil is collected in the oil-collecting space 13 and is discharged as needed through a valve 14 into the oil return line 9 which supplies the oil again to the crank space 3. The valve 14 may be embodied as a discontinuously operating valve and may have a spring 15, for example, which prestresses the valve 14 in its open direction when the oil mist separator 8 is not in operation, while the vacuum prevailing in the oil mist separator 8 in the operating state is so strong that the valve 14 is closed against the force exerted by the spring 15.

FIG. 3 shows a variant of the oil mist separator 8 and/or the throttle device 6 from FIG. 2, where a pressure-regulating valve 16 is provided instead of the nozzle 12. The pressure-regulating valve 16 may be embodied as a mushroom-head valve, for example, and also has a spring 15 that prestresses the pressure-regulating valve 16 in its open direction. The pressure-regulating valve 16 opens or closes to different extents, depending on the applied vacuum, so the pressure-regulating valve 16 is almost closed at a high vacuum, whereas when there is little or no vacuum, it is in its maximum open position. Downstream and opposite the pressure-regulating valve 16, the baffle 10 in turn has the nonwoven 11 arranged on it, so that the blow-by gases containing oil mist strike the nonwoven and preferably deliver their oil constituents completely. After saturation of the nonwoven 11, the oil drips down and flows into the oil-collecting space 13, from which it is drained occasionally through the valve 14 into the oil return line 9.

According to FIG. 4, a pressure-regulating element 7 with an elastic rotationally symmetrical diaphragm 17 is shown. The elastic diaphragm 17 is adjustable as a function of pressure along its direction of adjustment 18 and preferably assumes the position shown in FIG. 4 at little or no vacuum, whereas it preferably assumes the position shown in FIG. 5 when there is a high vacuum. On the inside, the elastic diaphragm 17 has a conical mandrel 19, which passes through a through-opening 20 in the pressure-regulating element 7 when the pressure-regulating element 7 is at least partially closed, so that together with an opening edge 21 of the through-opening 20, it forms a nozzle and is covered at least partially with a nonwoven 11 for separation of oil mist. The blow-by gas flowing from the crank space 3 thus flows between the mandrel 19 and the opening edge 21 of the through-opening 20 and strikes the nonwoven 11, which is arranged on the mandrel 19, such that it loses at least most of the oil it carries. In the remaining course, when the nonwoven 11 becomes saturated, the oil thus separated drips down and flows into the oil-collecting space 13, from whence it is drained out discontinuously through the valve 14 into the oil return line 9 in a known way.

As shown in FIGS. 4 and 5, an opposing mandrel 22 with which the mandrel 19 of the diaphragm 17 is in contact at a high vacuum is arranged opposite the mandrel 19 in the pressure-regulating element 7. Such contact is the case in particular with a closed pressure-regulating element 7, such that the opposing mandrel 22 presses into the nonwoven 11 of the mandrel 19.

In an area adjacent to the mandrel 19, the diaphragm 17 is covered with an elastomer 23 that is in tight contact with a rotationally symmetrical, circumferential bulge 24 of the through-opening 20 when the pressure-regulating element 7 is closed (see FIG. 5) and thereby closes the venting line 4. This forms a nozzle-like constriction due to the elastomer 23 on the one hand and the circumferential bulge 24 on the other hand, the passage cross-section of this constriction varying as a function of pressure, so that when there is a low vacuum, the passage cross-section between the elastomer 23 and the circumferential bulge 24 is large, whereas when the vacuum is high, the cross section is small or drops completely to zero.

In principle, it is also possible, as illustrated in FIG. 5, for a baffle 10' which is acted upon by oil mist to likewise or alternatively be covered with a nonwoven 11 for separation of oil mist in the area of the opposing mandrel 22. It is important here only that, if possible, the baffle 10, 10', which is provided for separation of oil mist, is arranged at the location where the velocity of flow of the blow-by gases is the greatest.

In general, the oil mist separator 8 integrated into the throttle device 6 or into the pressure-regulating element 7 according to this invention may be part of a rocker cover (not shown) or may be integrated into such a hood so that the functionality of the rocker cover may additionally be increased. It is also conceivable for the oil mist separator 8 that is integrated into the throttle device 6 or into the pressure-regulating element 7 to be integrated into a cylinder head cover.

In summary, the essential features of the inventive approach can be characterized as follows:

The invention proposes integrating an oil mist separator 8 into a pressure-regulating element 7, which is present anyway in a venting line 4 and/or in a throttle device 6 and thereby arranging the oil mist separator at a favorable location in terms of flow technology in the venting line 4 between the intake mechanism 5 and the crank space 3, thereby minimizing the installation space. This makes it possible to eliminate a separate arrangement of an oil mist separator 8, so that assembly costs and cost of materials can be saved on the one hand, and on the other hand, more appropriately dimensioned installation space can be better utilized.

All the features described in the description and in the following examples may be essential to the invention either individually or combined with one another in any form.

The invention claimed is:

1. A device for venting a crank space in an internal combustion engine, comprising:

a suction device for suction removal of blow-by gases from the crank space, wherein a vacuum is created by the suction device in the crank space;

a venting line leading from the crank space to the suction device, one of a throttle device and a pressure-regulating element arranged in the path of the venting line to limit the vacuum created by the suction device in the crank space, and an oil mist separator that is an impacter integrated into one of the throttle device and the pressure-regulating element that is selected;

wherein the pressure-regulating element is selected and has one of a spring-loaded throttle valve and an elastic, rotationally symmetrical diaphragm; and wherein the elastic diaphragm is selected and has a conical mandrel which passes through a through-opening in the selected pressure-regulating element when the pressure-regulating element is at least partially closed such that, together with an opening edge of the through-opening, the elastic diaphragm forms a nozzle and is covered at least partially with a nonwoven material for separation of oil mist.

2. The device according to claim 1, wherein an opposing mandrel, which is arranged opposite the mandrel in the pressure-regulating element, with which the mandrel of the elastic diaphragm is in contact when the pressure-regulating element is closed.

3. The device according to claim 2, wherein a baffle that receives oil mist is covered with a nonwoven material for separation of oil mist in an area of the opposing mandrel.

4. The device according to claim 2, wherein the elastic diaphragm is covered with an elastomer in an area adjacent to the mandrel, the elastomer being in tight contact with a rotationally symmetrical, circumferential bulge at the through-opening and thereby closing the venting line when the pressure-regulating element is closed.

5. The device according to claim 4, wherein a nozzle including a passage cross-section changing as a function of pressure is formed by the elastomer on a side and by the circumferential bulge on another side.

6. The device according to claim 1, wherein the elastic diaphragm is covered with an elastomer in an area adjacent to the mandrel, the elastomer being in tight contact with a rotationally symmetrical, circumferential bulge at the through-opening and thereby closing the venting line when the pressure-regulating element is closed.

7. The device according to claim 6, wherein a nozzle including a passage cross-section changing as a function of pressure is formed by the elastomer on a side and by the circumferential bulge on another side.

8. The device according to claim 6, wherein a baffle that receives oil mist is covered with a nonwoven material for separation of oil mist in an area of the opposing mandrel.

9. A device for venting a crank space in an internal combustion engine, comprising:

a suction device for suction removal of blow-by gases from the crank space, wherein a vacuum is created by the suction device in the crank space;

a venting line leading from the crank space to the suction device, one of a throttle device and a pressure-regulating element arranged in the path of the venting line, and an oil mist separator that is an impacter integrated into one of the throttle device and the pressure-regulating element that is selected;

wherein the oil mist separator is positioned such that the blow-by gasses are accelerated by the one of the throttle device and the pressure-regulating element into the oil mist separator;

wherein the oil mist separator is connected to the crank space by an oil return line;

wherein the pressure-regulating element is selected and has one of a spring-loaded throttle valve and an elastic, rotationally symmetrical diaphragm; and wherein the elastic diaphragm is selected and has a conical mandrel which passes through a through-opening in the selected pressure-regulating element when the pressure-regulating element is at least partially closed such that, together with an opening edge of the through-opening, the elastic diaphragm forms a nozzle and is covered at least partially with a nonwoven material for separation of oil mist.

10. The device according to claim 9, wherein an opposing mandrel, which is arranged opposite the mandrel in the pressure-regulating element, with which the mandrel of the elastic diaphragm is in contact when the pressure-regulating element is closed.

11. A device for venting a crank space in an internal combustion engine, comprising:

a suction device for suction removal of blow-by gases from the crank space, wherein a vacuum is created by the suction device in the crank space;

a venting line leading from the crank space to the suction device, one of a throttle device and a pressure-regulating element arranged in the path of the venting line to limit the vacuum created by the suction device in the crank space, and an oil mist separator that is an impacter integrated into one of the throttle device and the pressure-regulating element that is selected;

wherein the oil mist separator has an oil-collecting space which is connected by a valve to the oil return line wherein the pressure-regulating element is selected and has one of a spring-loaded throttle valve and an elastic, rotationally symmetrical diaphragm; and wherein the elastic diaphragm is selected and has a conical mandrel which passes through a through-opening in the selected pressure-regulating element when the pressure-regulating element is at least partially closed such that, together with an opening edge of the through-opening, the elastic diaphragm forms a nozzle and is covered at least partially with a nonwoven material for separation of oil mist.

* * * * *